US006474349B1

(12) United States Patent
Laker

(10) Patent No.: US 6,474,349 B1
(45) Date of Patent: Nov. 5, 2002

(54) ULTRASONIC CLEANOUT TOOL AND METHOD OF USE THEREOF

(75) Inventor: Keith Trevor Laker, Guernsey (GB)

(73) Assignee: Hamdeen Limited, Isle of Man (GB)

( * ) Notice: Subject to any disclaimer, the term of this patent is extended or adjusted under 35 U.S.C. 154(b) by 0 days.

(21) Appl. No.: 09/441,463

(22) Filed: Nov. 17, 1999

(30) Foreign Application Priority Data

Nov. 17, 1998 (GB) ..... 9825167

(51) Int. Cl.[7] ..... B08B 9/02

(52) U.S. Cl. ..... 134/22.12; 134/22.18; 134/169 C; 134/168 C; 134/184; 166/171

(58) Field of Search ..... 134/184, 166 R, 134/167 R, 168 C, 167 C, 169 C, 166 C, 22.11, 22.12, 22.18; 15/104.31, 104.05, 104.16; 166/222, 223, 171, 172, 56

(56) References Cited

U.S. PATENT DOCUMENTS 3,646,947 A * 3/1972 Rochelle et al.
3,866,679 A * 2/1975 Laky
4,349,073 A * 9/1982 Zublin
4,442,899 A * 4/1984 Zublin
4,475,255 A * 10/1984 Tash
4,625,799 A * 12/1986 McCormick et al.
4,705,107 A * 11/1987 Council et al.
4,750,547 A 6/1988 Sakamoto ..... 165/84
4,763,728 A * 8/1988 Lacey
4,799,554 A * 1/1989 Clapp et al.
5,318,128 A * 6/1994 Johnson et al.
5,529,635 A 6/1996 Odell ..... 134/1
5,595,243 A 1/1997 Maki, Jr. et al. ..... 166/177.2
5,676,213 A 10/1997 Auzerais et al. ..... 175/58
5,727,628 A 3/1998 Patzner ..... 166/249
5,768,741 A * 6/1998 Leiman et al.
5,836,394 A * 11/1998 Blank

* cited by examiner

*Primary Examiner*—Frankie L. Stinson
(74) *Attorney, Agent, or Firm*—Fleshner & Kim, LLP

(57) ABSTRACT

Apparatus for cleaning well bore tubulars comprises an ultrasound source suspended on a work string adapted to be run in the well, wherein the ultrasound source provides sufficient ultrasonic energy to remove scale or other undesirable debris or particles from, the well bore tubular.

15 Claims, 3 Drawing Sheets

ULTRASONIC CLEANOUT TOOL AND METHOD OF USE THEREOF

This invention relates to the use of ultrasonics as a means of cleaning tubulars. The invention provides or an ultrasonic tool that finds one application in the cleaning of down-hole completions. Other applications include production pipelines, sewage pipes, power stations, process facilities, refineries etc.

Herein, references to scale should be construed broadly and other deposits, particles, debris or the like, including for example waxes, grease and ashphaltines, may be substituted as alternatives to this term.

The development of scale in down-hole completions is known to have detrimental implications for the economic prosperity and operating efficiency of a well. Specifically, the collection of scale on a well's production tubing, casing and perforations serves to impose a constriction on the circulation and production flow paths, thereby limiting production capability. The full extent of the problem may be further realised in light of the additional costs associated with the removal of the scale, together with the loss of production while so doing.

Typically, scale may comprise strontium sulphate (notably a radioactive substance), barium sulphate, calcium carbonate and so on and may result from precipitation of fluids in the well or pipeline. For example, the formation of scale may result from these substances coming out of solution of the production fluid as it undergoes a pressure drop when, such as in an oil well, it passes from the oil reservoir into the well bore via perforations in the production casing. Furthermore, this may be exacerbated as a result of water flooding a reservoir using seawater. Seawater eventually "breaks through" to the production perforations resulting in the formation of other scales, typically barium sulphate.

The scale, while known to form in the production flow paths, often collects in areas that are difficult to clean or access, such as side pockets, production devices and the perforations in production casing.

In the past a number of alternative methods of removing or mitigating the effect of the formation of scale have been contemplated. In one case, the use of chemicals has been employed; the chemicals being adapted to inhibit the adherence of the scale deposits on the reservoir rock and well tubing. However, a disadvantage associated with this solution is that the chemicals only have a finite life and lose their effectiveness over time, necessitating regular re-application.

Another proposed method involves the use of chemicals in a remedial manner, namely to remove scale that has formed on the tubing. The chemicals, of this type, incorporate dissolving agents to attack the scale deposits. Unfortunately, these chemicals tend to be relatively expensive and slow acting.

Additional, both of the above types of chemicals can be detrimental to the surrounding environment, and usually involve the production or wastage of by-products arising from their manufacture or use, which may be abrasive in the well bore or harmful to the environment upon their disposal. Some of these chemicals are also hazardous to handle and, in this way, further undesirable.

Other methods of attacking or minimising scale involve physical means, but again, operations such as milling or grinding are slow, expensive and not entirely effective. Other physical operations involve bead blasting and have the aforementioned drawbacks with the added difficulty of handling the beads, both before and after use.

It may be seen therefore that until now there has been a lack of an effective or satisfactory system for scale removal in down-hole oil field applications that removes all scale, including the scale formed in remote or difficult areas such as side pockets or perforations, and which does not damage the tubular/cement/formation bond or have a waste by product of its own.

Another desirable attribute of a suitable means or agent for scale removal or prevention is that the means or agent should be deployed using standard running or well equipment.

In the present invention it is understood that the use of ultrasonics may provide an effective method for removing the scale or other matter such as wax or asphaltines.

Ultrasound is highly versatile and can be used in a broad range of applications from medical treatments to chemical transformations.

The effects of ultrasound are achieved by the formation of cavities in the medium through which the ultrasound is used. The formation of the cavities is as a result of the rarefaction of the medium and as a consequence bubbles are formed. Cavitation bubbles are created at sites of rarefaction as the liquid fractures or tears because of the negative pressure of the sound wave in the liquid. As the wave fronts pass, the cavitation bubbles oselate under the influence of positive pressure, eventually growing to an unstable size. Finally, the violent collapse of the cavitation bubbles results in implosions, which cause shock waves to be radiated from the sites of the collapse. The collapse and implosion of meriede cavitation bubbles throughout an ultrasonically activated liquid result in the effect commonly associated with ultrasonics. It has been calculated that temperatures in excess of 10,000 degrees fahrenheit and pressures in excess of 10,000 psi are generated at the implosion sites of cavitation bubbles.

British Patent GB 2 165 330A provides an example of the use of ultrasound as a cleaning system. This system relies on the focussing of the ultrasonic energy using a parabolic curve or a flat array in combination with a focusing means. However, this system would not be suitable for general cleaning operations that require precise focussing of the ultrasonic energy.

It is an object of the present invention to provide an ultrasonic tool that may be used in the cleaning of down-hole completions.

A further object of the invention is to provide an ultrasonic tool that is equally suitable for cleaning well casing, well liner or the well riser, irrespective of varying diameters.

A yet additional and desirable objective would be to provide an ultrasonic tool that, while capable of providing a cleaning function in a oil or gas drilling well, also had the capability of stimulating production by a process of mircofracturing rock formation so as to create additional flow paths in the producing zone. It is intended that the present invention meets this objective.

According to a first aspect or the present invention there is provided apparatus for cleaning tubulars, the apparatus comprising mechanical vibration means for creating acoustic waves, a high frequency current electrical source and a polarisation current source, wherein electrical current generated by the said sources is used to excite or activate the mechanical vibration means.

Preferably the mechanical vibration means is a submersible magnetostriction vibrator.

The apparatus is most typically suitable for cleaning well bore tubulars, and may further comprise an electric conductive wireline cable on which the acoustic vibrator is adapted to be run into the well, wherein the high frequency and polarisation electrical sources are adapted to be positioned at surface, and physically connected to the wireline cable for the conducting of electrical current to the vibrator.

Also according to the first aspect of the present invention there is provided apparatus for cleaning well bore tubulars, the apparatus comprising an ultrasound source suspended on a work string adapted to be run in the well, wherein the ultrasound source provides sufficient ultrasonic energy to remove scale or other undesirable debris or particles from the well bore tubular.

The ultrasound source may be a sonic horn or node. An alternative or additional ultrasound source may also be employed.

The work string may be wireline cable, drill pipe or coil tubing.

The apparatus may further comprise an insulator for preventing the diffusion of sonic energy in a direction up the work string to which the acoustic vibrator may be attached, in use.

The apparatus may further be provided with means for directing the ultrasonic energy; for example one or more nozzles may be incorporated onto the tool and associated with the ultrasound source for the purpose of directing the emitted energy.

Optionally, the apparatus comprises an ultrasound source comprising a body member having an internal profile adapted to manipulate fluid pressure therein. For this reason, the tool may advantageously be provided with a means for regulating the internal pressure. Such means may comprise one or more valves that co-operate to prevent relatively high pressures from migrating back up the tool string. The valves should be provided in sufficient quantity and positioned to enable such pressures to be distributed and to provide back-up in the event of partial failure.

Typically, the profile of the tool body would include convergent and divergent flow paths for the purpose or manipulating and increasing the fluid pressure.

Where, as is preferred, the ultrasound source is a magnetostriction vibrator it may comprise of two blended packages connected by a wave guide means, wherein the blended packages include cores to which excitation and polarisation windings are applied.

According to a second aspect to the present invention there is provided a method for cleaning a tubular, the tubular supporting or containing a fluid, the method comprising the steps of introducing an ultrasound source into the liquid within the tubular and activating same so as to provide ultrasonic energy from the source via the fluid in order to remove scale or other debris or particles from the tubular.

The method may comprise the steps of generating high energy fluid in the ultrasound source, thereby emitting ultrasonic energy from the source via the fluid in order to remove scale from the tubular.

The tubular may be provided in a oil or gas well bore, such as well casing, well liner or well riser. Therefore, the method may further comprise attaching the ultrasound source to a work string and lowering said work string into the well bore.

The method may also involve the adjustment of the output of the tool to achieve the required de-scaling without damaging the down-hole completion.

The method may further involve the recycling of dislodged material through the tool to assist the removal of scale.

Also according to the second aspect of the present invention there is provided a method for cleaning a well bore, the method comprising the steps of activating a submersible magnetostriction vibrator provided on a conductive wireline cable suspended in the well bore by means of surface modules adapted to generate appropriate electrical current to the magnetostriction vibrator via the wireline cable, wherein the said electrical current is converted by the magnetostriction vibrator into. mechanical vibrations adapted to generate ultrasonic energy, and wherein said ultrasonic energy is adapted to clean the well bore tubular.

Preferably also, the activation of the magnetostriction vibrator provides a combined acoustic-thermal effect on the well and any oil therein.

Preferably also, the method comprises a means of cleaning the pores or passageways in the oil bearing layer of the well bore formation.

Preferably also, the method comprises the process of thinning oil in the vicinity of the ultrasound source.

In order to provide a better understanding of the present invention, an embodiment will now be described by way of example only, with reference to the accompanying Figures in which.

Figure 1:
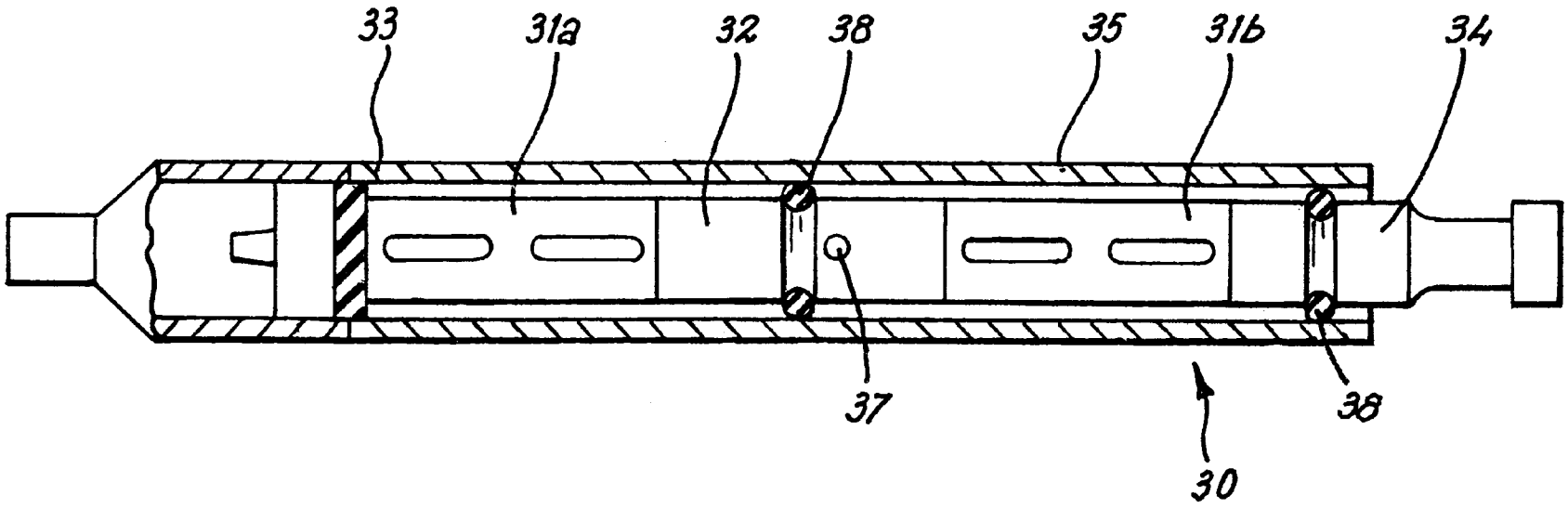
FIG. 1 illustrates an ultrasound source in accordance with the invention.

FIG. 1 illustrates an ultrasound source in the form of a submersible magnetostriction vibrator, generally depicted at 30. The vibrator 30 includes two blended packages at 31*a,* 31*b,* made of ferronickel alloy. This material has been selected as preferable as it has an increased magnetostriction dependence on the magnitude of the magnetic flux in the packages. Each package 31*a,* 31*b* is associated with a core upon which conductive windings are applied. The windings are series connected.

The packages 31*a,* 31*b* are joined by a wave guide 32, typically using a soldering technique. A rubber strap 33 dampens one of the free end faces of the packages, the second end face is soldered to a concentrator 34, which is the working component of the vibrator 30.

On the concentrator 34 and on the wave guide 32 there are provided grooves in which rubber rings 38 are inserted. The wave guide 32 also has a hole or aperture 37 to enable its attachment to a surrounding pipe 35, typically made of stainless steel.

Figure 2:
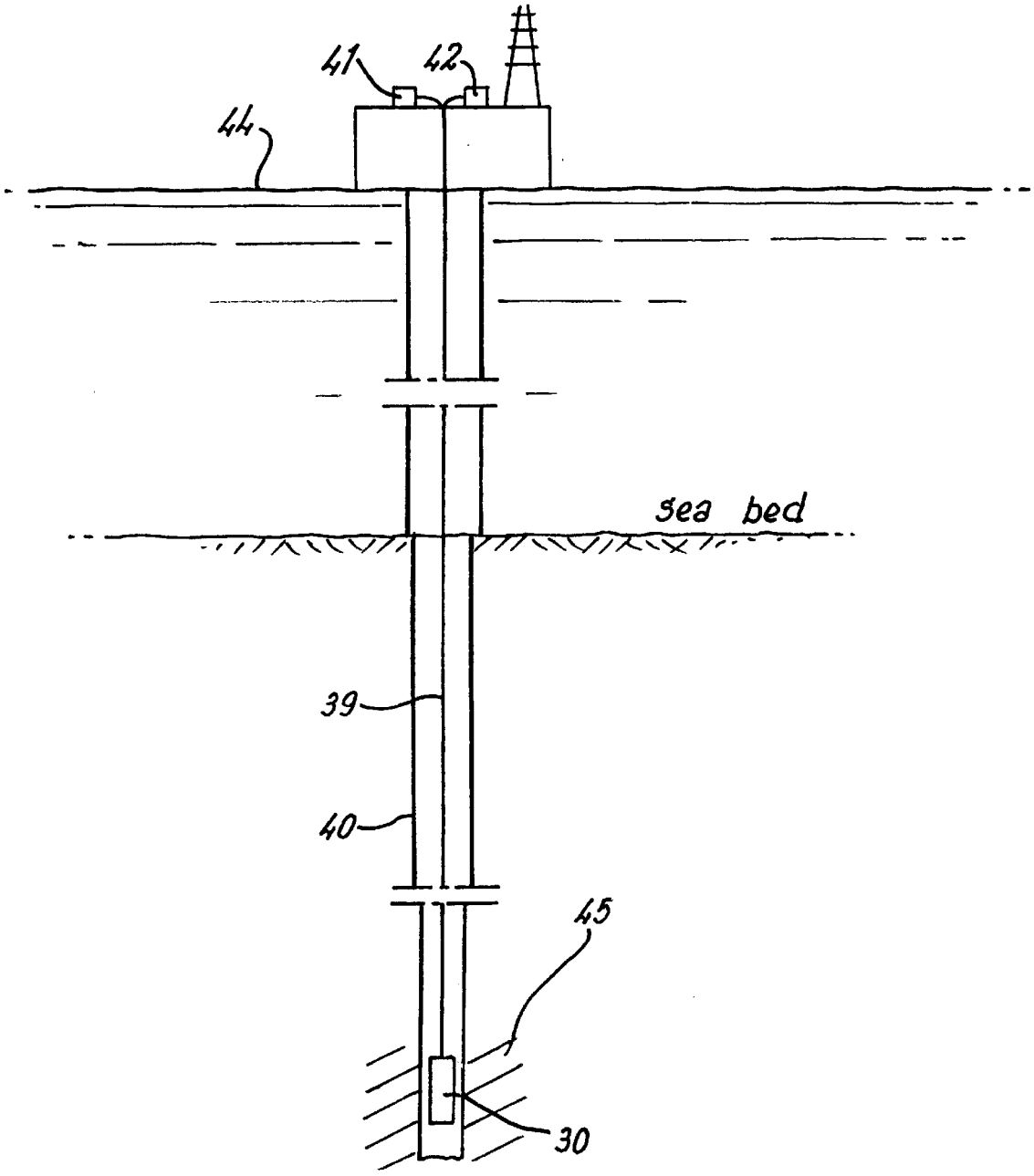
FIG. 2 shows a schematic diagram of apparatus, incorporating the ultrasound source depicted in FIG. 1.

It may be seen from FIG. 2 that the acoustic vibrator 30 is intended to be run on a conductive cable wire 39 in, for example, a well bore 40. At the surface 44 of the well there is provided, as part of the apparatus, a semiconductor high frequency generator 41 and a polarisation module 42. The high frequency generator 41 and polarisation module 42 are adapted to send, respectively, a high frequency current and a polarisation current to the windings on the packages of the acoustic vibrator 30. When high frequency voltage is supplied to the windings of the packages, the changing electromagnetic field causes elastic mechanical vibrations of the acoustic system. The vibrations are transmitted to the concentrator 34 via the end face of one of the packages 31.

To increase the acoustic power of the vibrator 30, the packages are polarised by direct current, which flows via the excitation windings simultaneously with alternating current.

In a preferred embodiment, the high frequency generator 41 is associated with a control system (not shown) incorporating a micro processor which implements the following functions:

a. Automatic or manual frequency control;

b. Stabilisation at a specified wattage level;

c. Monitoring of voltage of the control system power supply and the temperatures of the transistors of the generator;

d. Switching roe generator on and off, depending on the onset of a number of conditions; and e. Measuring and displaying the process perimeters.

In use, the submersible vibrator 30 is run into the oil well on the conductive wireline cable 39. The cable parameters significantly control the unit characteristics. The recommended type is logging cable, which has seven insulated conductors of 0.75 mm squared section. To connect the surface modules 41, 42 to the vibrator 30, six conductors of the cable may be used, these being connected by three in parallel. These will supply high frequency current and polarisation current, the total efficient value of which should not exceed 20 amps.

It is to be understood that the acoustic vibrator provides a combined acoustic-thermal effect on the well and any oil in the well, while also cleaning the pores in the oil bearing layer 45. A further advantage of the apparatus described herein is its ability to thin the oil in the well, thereby reducing the oil interfacial tension forces and improving gas lift by a process of oil degassing. Cavitation occurring in consequence to activation of the acoustic vibrator destroys precipitation such as scale and asphaltines in the well bore tubulars and also in the well formation. Similarly, the combination of cavitation and ultrasonic vibration destroys precipitation and any natural cementation of the formation and thereby improve the flow of oil to the well bore This stimulates production volumes from the well.

Figure 3:
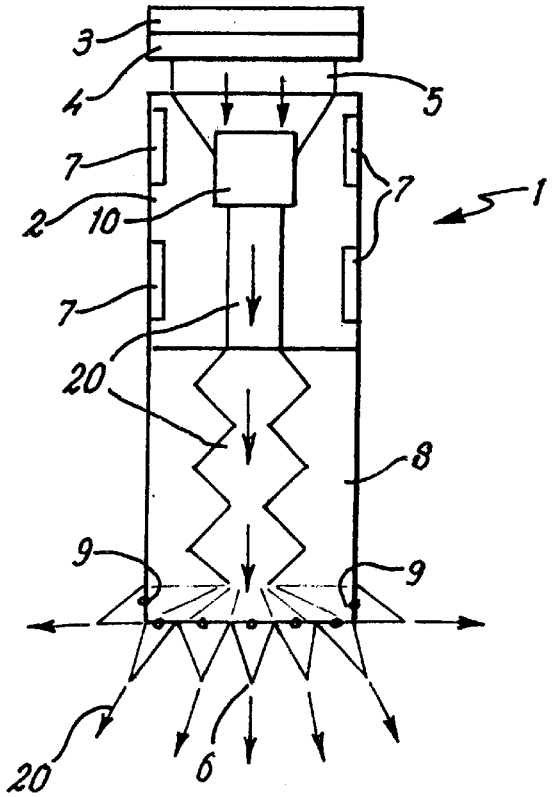
FIG. 3 illustrates an alternative ultrasonic cleanout tool.

Referring now to FIG. 3 an ultrasonic cleanout tool is generally depicted at 1. The tool 1 comprises a main tool body 2 having an internal flow path 20. The flow path 20 is formed with a convergent/divergert profile for generating pressure pulses in fluid passing therethrough.

The tool body 2 is attachable to a tool string by a connector 3. The connector 3 is adjacent to shock sub protector 4 that acts to isolate and pressure surges from travelling up a respective tool string to which the tool 1 is attached. The connector 3 and protector 4 are joined to the tool body 2 via a disconnect 5.

Toward the lower end of the tool body 2, and more particularly, the flow path 20 are a series of supersonic nozzles 6.

The main tool body 2 is provided with a series of check valves 7 to regulate the internal pressure of the tool 1 and prevent any detrimental effects from reaching the coiled tubing.

The flow path 20 within the tool body 2 is provided with a fluid expansion chamber 8 and a series of profiled nodes 9. The chamber 8 and the nodes 9 in combination induce parabolic shock waves in the fluid flow.

The tool 1 may be operated in the following way. Typically water, which is used as both the generating and cleaning medium, is pumped through the coiled tubing and enters the tool 1 via the connector 3 and passes into the fluid expansion chamber 8. The fluid expansion chamber 8 can either constrict or compress the fluid via either convergent or divergent profiling resulting in an increase n the pressure of the water. The valves 7 also regulate the internal pressure of the tool body 2 and prevent any increase in pressure from migrating to the coiled tubing. The water or other fluid, which is now at a higher pressure, is directed to the series of profiled nodes 9. The nodes 9 are the source of the ultrasound and are shaped to induce parabolic shock waves. The fluid is directed through the nodes 9 and at the same time becomes further compressed generating a higher fluid pressure and shock waves in the form of a high energy, acoustic stream. The resultant fluid stream is directed through the nozzles 6 towards the scale.

The ultrasonic shock waves now act on the scale resulting in a tensile failure within the lattice of the scale. The pressure of the water or other fluid further assists the de-scaling process.

The tool 1 is also provided with a venturi input port 10 through which small granules of scale may pass into the tool 1 to be recycled and incorporated as part of the jetting/cleaning medium.

Furthermore as the scale particles being been broken down by she above processes get progressively smaller they lose gravitational pull and rise in the well-bore annulus by virtue of the pumped fluid.

The ultrasonic output of the tool 1 can be adjusted such that the use of the tool 1 can be tailored to meet the requirements of the cleaning process without damaging the well-bore.

Figure 4:
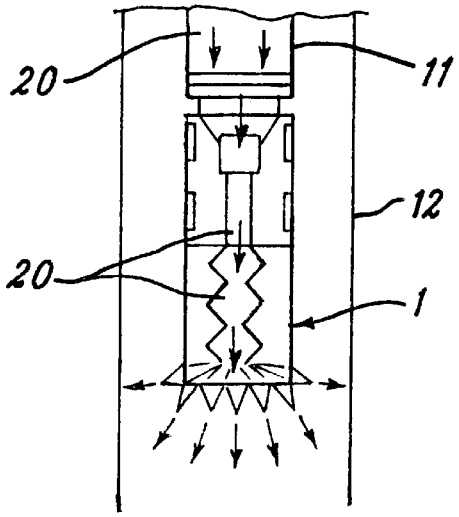
FIG. 4 illustrates the tool of FIG. 3 attached to coiled tubing in a well bore completion.

FIG. 4 illustrates the tool 1 in its position of operation at the base of coiled tubing 11 in a well-bore 12. The arrows indicate the flow of fluid through the tool 1 and the nozzles 6.

In this latter described example embodiment, the scale is removed by means of the pumped fluid returning via the annulus between the coiled tubing and the production tubing.

An advantage of the present invention is that there is provided a down-hole tool that can efficiently clean the inner surfaces of a well-bore without the production of any waste from the tool itself.

The output of the tool can also altered depending on the nature of the scale that is required to be removed so that there is no damage to the well-bore.

The tool has the further advantage of being easily attached to the base of the coiled tubing or wireline.

Further improvements and modifications can be made without departing from the scope of this invention herein intended. It should also be appreciated herein that while the removal of scale is largely contemplated in this specification, the present invention is not limited to the cleaning of scale only, but finds application in the removal or cleaning of other debris or deposits that may be found in well-bore tubulars and other flowlines such as production pipelines, sewage pipes etc.

What is claimed is:

1. Apparatus for cleaning tubulars, the apparatus comprising mechanical vibration means for creating acoustic waves, a high frequency current electrical source and a polarisation current source, wherein electrical current generated by the said sources is used to excite or activate the mechanical vibration means.

2. Apparatus as claimed in claim 1 wherein the mechanical vibration means is a submersible magnetostriction vibrator.

3. Apparatus as claimed in claim 2, wherein the magnetostriction vibrator comprises of two blended packages connected by a wave guide means, wherein the blended packages include cores to which excitation and polarisation windings are applied.

4. Apparatus as claimed in claim 1 suitable for cleaning well bore tubulars, and further comprising an electric conductive wireline cable on which the acoustic vibrator is adapted to be run into the well, wherein the high frequency and polarisation electrical sources are adapted to be positioned at surface, and physically connected to the wireline cable for the conducting of electrical current to the vibrator.

5. Apparatus for cleaning well bore tubulars, the apparatus comprising an ultrasound source suspended on a work string, the work string being suspended on drill pipe and the work string adapted to be run in the well, wherein the ultrasound source comprises a body member having an internal profile adapted to manipulate fluid pressure therein, the profile of the tool body to include convergent and divergent flow paths for the purpose of manipulating and increasing fluid pressure so that the ultrasound source provides sufficient ultrasonic energy to remove scale or other undesirable debris or particles from the well bore tubular.

6. Apparatus as claimed in claim 3 wherein the work string is suspended on coil tubing.

7. The apparatus as claimed in claim 6 further comprising a means of cleaning pores in an oil bearing layer of the well bore.

8. Apparatus as claimed in claim 5 further comprising an insulator for preventing the diffusion of sonic energy in a direction up the work string to which the acoustic vibrator may be attached, in use.

9. The apparatus as claimed in claim 8, wherein the ultrasound source comprises a magnetostriction vibrator with two blended packages connected by a waveguide means.

10. Apparatus for cleaning well bore tubulars, the apparatus comprising an ultrasound source suspended on a work string adapted to be run in the well, wherein the ultrasound source provides sufficient ultrasonic energy to remove scale or other undesirable debris or particles from the well bore tubular, the apparatus further comprising means for directing the ultrasonic energy the means for directing the ultrasonic energy being one or more nozzles incorporated onto the tool for the purpose of directing the emitted energy, wherein the ultrasound source is located within the one or more nozzles.

11. The apparatus as claimed in claim 10, wherein the ultrasound source comprises profiled nodes adjacent to the one or more nozzles, wherein the nodes induce parabolic shock waves.

12. A method for cleaning a well bore, the method comprising the steps of activating a submersible magnetostriction vibrator provided on a conductive wireline cable suspended in the well bore by means of surface modules adapted to generate a high frequency current and a polarization current to the magnetostriction vibrator via the wireline cable, wherein the said currents are converted by the magnetostriction vibrator into mechanical vibrations adapted to generate ultrasonic energy, and wherein said ultrasonic energy is adapted to clean the well bore tubular.

13. A method as claimed in claim 12 wherein the magnetostriction vibrator provides a combined acoustic-thermal effect on the well and any oil therein.

14. A method as claimed in claim 12 further comprising a means of cleaning the pores or passageways in the oil hearing layer of the well bore formation.

15. The method claimed in claim 12 comprising the process of providing thermal energy to the oil thereby thinning the oil in the vicinity of the ultrasound source.

* * * * *